United States Patent [19]

Haaf

[11] 4,295,938

[45] Oct. 20, 1981

[54] COKE-OVEN DOOR ASSEMBLY

[75] Inventor: Friedhelm Haaf, Velbert, Fed. Rep. of Germany

[73] Assignee: Fried. Krupp Gesellschaft mit beschränkter Haftung, Essen, Fed. Rep. of Germany

[21] Appl. No.: 190,166

[22] Filed: Sep. 23, 1980

[30] Foreign Application Priority Data

Sep. 27, 1979 [DE] Fed. Rep. of Germany ..... 2939070

[51] Int. Cl.[3] ..... C10B 25/06

[52] U.S. Cl. ..... 202/248; 110/173 R

[58] Field of Search ..... 202/248, 269; 110/173 R

[56] References Cited

U.S. PATENT DOCUMENTS 3,974,038 8/1976 Tucker ..... 202/248

FOREIGN PATENT DOCUMENTS 541252 1/1932 Fed. Rep. of Germany ..... 202/248

1018390 10/1957 Fed. Rep. of Germany .

1091982 11/1960 Fed. Rep. of Germany ..... 202/248

*Primary Examiner*—Frank W. Lutter

*Assistant Examiner*—Roger F. Phillips

*Attorney, Agent, or Firm*—Karl F. Ross

[57] ABSTRACT

A coke-oven door assembly has a doorjamb having an outwardly facing annular doorjamb surface. A rigid door body has an annular outer edge aligned with and generally perpendicular to the doorjamb surface and is provided with an annular and hollow rigid frame juxtaposed with this edge and limitedly displaceable relative to the door body. An annular seal strip engages the door edge and bears inwardly on the doorjamb surface. A rail is movable inside the frame toward and away from the doorjamb surface and a plurality of elastically compressible biasing devices are engaged between the rail and the seal strip to urge the latter toward the doorjamb surface. A plurality of spacers extending from the doorjamb are engaged with this rail, normally via respective plungers, so that the biasing force effective on the seal strip remains the same even if the door body is distorted by the effects of heat.

10 Claims, 5 Drawing Figures

COKE-OVEN DOOR ASSEMBLY

FIELD OF THE INVENTION

The present invention relates to a coke-oven door assembly. More particularly this invention concerns a sealing arrangement for a coke-oven door assembly.

BACKGROUND OF THE INVENTION

A coke-oven door normally has a massive metallic door body adapted to fit against the doorjamb of the respective coke oven. This door body carries on its inner face a refractory plug that extends into the respective coking chamber and directly engages the charge in this chamber.

In order to prevent the dangerous vapors created during the coking operation from escaping from the oven an annular seal is normally provided extending around the edges of the door and which engages the annular doorjamb surface. This seal is normally made of metal to be able to resist the high temperatures of operation of the coking oven.

Practice was normally to ensure a snug fit between the seal strip and the doorjamb simply by mounting it for limited displacement toward and away from the doorjamb. Once the door was fitted tightly to the doorjamb, normally by extensive and heavy-duty latching arrangements, the seal is pounded by the operator of the furnace into tight contact with the doorjamb surface. This procedure has been found to be relatively unsatisfactory not only because it requires considerable work so that a proper seal is ensured, but even at best the seal frequently leaks at several locations.

According to printed German application No. 1,018,390 of Paul Van Ackeren it is known to provide a Z-section seal having one leg clamped to the edge of the door and another leg urged by a plurality of spring-loaded pushers toward the doorjamb surface. These pushers each consist of an element engaging the seal and displaceable toward and away from the doorjamb on the door body, a spring engaging this element, and a screw threaded in the door body capable of increasing or decreasing the compression of the spring between it and the element. Such an arrangement ensures a relatively tight fit so long as the door body remains perfectly parallel to the doorjamb.

It is, however, fairly common for the door bodies to become distorted due to the effects of heat. In this situation, therefore, the above-described seal systems will leak considerably, although the availability of some biasing force in the second-described system does allow minor distortions to be compensated for. Even with such compensation, however, the amount of force with which the seal is pressed against the doorjamb is decreased considerably in a region where the door body has distorted away from the doorjamb.

Another system is described in U.S. Pat. No. 3,974,038 of Tucker. Here, once again, a seal strip is urged by a plurality of spring-loaded arrangements against the doorjamb. Extending axially through the center of the biasing screw is a rod which allows the user readily to ascertain the position of the seal at each biasing unit relative to the respective biasing unit. This system, however, suffers from the same disadvantage as the other above-described systems in that thermally caused distortions of the door body will pull the entire arrangement, including the biasing unit, away from the doorjamb in some spots and push it toward the doorjamb in other spots. The result is a potential leak.

OBJECTS OF THE INVENTION

It is therefore an object of the present invention to provide an improved coke-oven door assembly.

Another object is to provide such an assembly wherein the seal strip will be maintained in tight contact with the doorjamb even if the door body is distorted from its normal shape by the effects of heat.

SUMMARY OF THE INVENTION

These objects are attained according to the instant invention by providing on the door body an annular and hollow rigid frame which is juxtaposed with the edge of the door. A rail is provided inside this frame and is movable toward and away from the doorjamb surfaces, with a plurality of elastically compressible biasing devices being provided between this rail and the seal strip to urge same toward the doorjamb surface. A plurality of spacers are engaged between the doorjamb and the rail in the frame for maintaining this rail at a predetermined spacing from the doorjamb. Thus in accordance with the instant invention the rail which can move relative to the hollow frame and, therefore, also relative to the door body will be maintained by the spacers at a fixed distance from the doorjamb, regardless of any thermally caused distortions of the door body. Such a system therefore allows the door body to become relatively greatly distorted without in any way interfering with the seal between the door and the doorjamb.

According to further features of this invention the frame is limitedly displaceable relative to the doorjamb. This feature even further ensures that thermally caused distortions of the door body are not transmitted to the seal. The frame, which is made like a box girder, therefore will remain nearly perfectly planar even if the door becomes rather greatly distorted. Combinations of slide and pivot joints between the door and body and the frame ensure this limited relative displaceability. Normally the pivot joints are provided on the long vertical sides of the door adjacent the one short end thereof and the slide joints adjacent the other short end thereof, with the relative slidability being in the plane of the door. Thus if the door is heated and expands the frame will not itself be distorted.

The spacers are formed with hooks pivoted about vertical axes on the sides of the doorjamb. They have outer hook ends formed with camming surfaces that operatively engage the rail. According to this invention a plunger guided in the hollow frame is provided at each of the hooks for transmitting force from the respective hook to the rail.

Thus with this system the door is fitted to the doorjamb via the various locking arrangements that are standard on such doors, then the spacers are flipped up so as to cam in the outer ends of the plungers that engage the rails, thereby ensuring even biasing all around on the strip. Even if the door twists somewhat the strip will remain evenly biased against the doorjamb.

According to yet another feature of this invention the biasing devices are constituted as a pair of telescoping cylindrical cups faced toward each other and having springs engaged between the bases of the cups. Thus these units are completely sealed for best protection of the spring and can be counted on to have a long service life.

SPECIFIC DESCRIPTION

Figure 1:
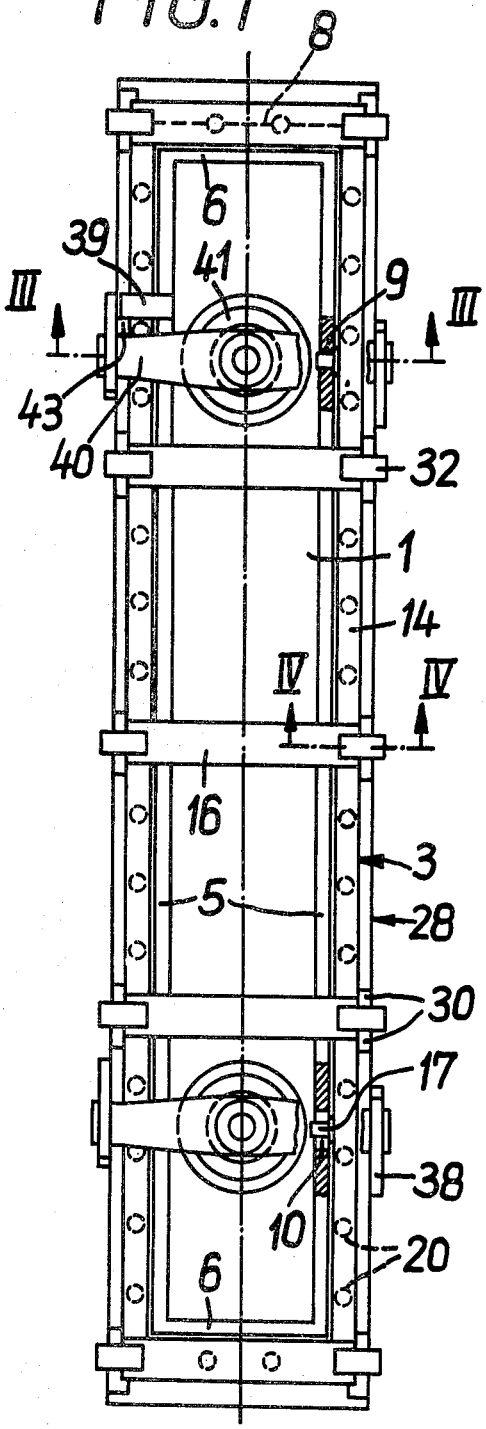
FIG. 1 is an elevational view of the outside of a door according to this invention.
Figure 2:
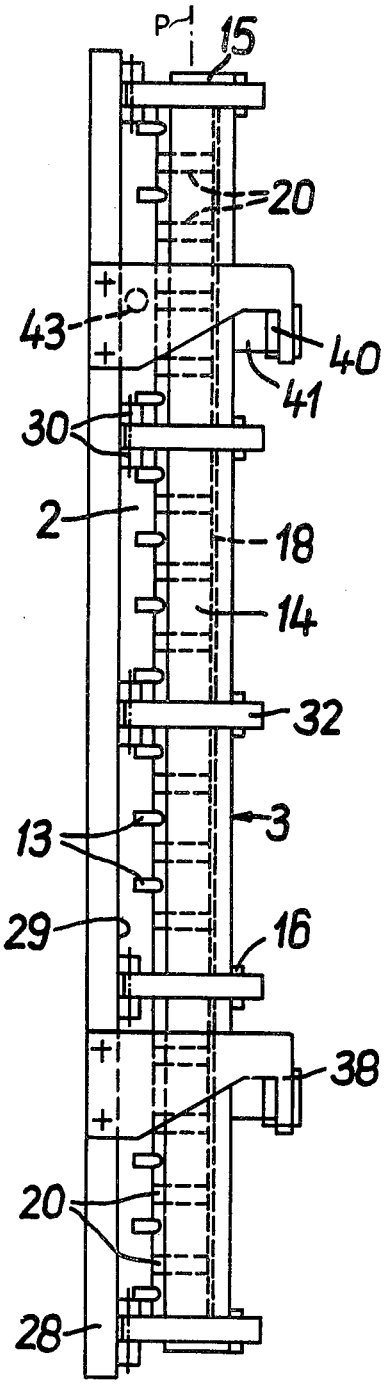
FIG. 2 is a side view of the door of FIG. 1.

As is seen in FIGS. 1–4 a door assembly according to this invention basically comprises a rigid cast-iron door body 1 having a central rectangular panel 4 having a pair of long upright side edges 7 and a pair of short horizontal end edges 8 and formed integrally with a pair of outwardly directed side flanges 5 and a pair of outwardly directed end flanges 6. The edges 7 and 8 are perpendicular to the outer face 29 of the doorjamb 28 and each engage a seal 2. The inner face of the panel 4 carries holders 11 for refractory blocks 12 forming the standard cast plug. Extending all around the flanges 5 and 6 and spaced slightly outwardly therefrom is a frame 3 formed as a box girder, that is of hollow rectangular section, and itself formed by upright longitudinal members 14 extending along the side flanges 5 and horizontal transverse members 15 extending along the end flanges 6. The side flanges 5 are both formed adjacent their upper ends with cylindrical holes 9 defining an axis parallel to the plane of the door and perpendicular to the sides 7 and adjacent their lower ends with slots 10 extending in the plane of the door. Frame 3 is provided with pins 17 extending inwardly into these holes and slots 9 and 10 and allowing limited relative displacement between the frame 3 and the door panel 4.

Figure 3:
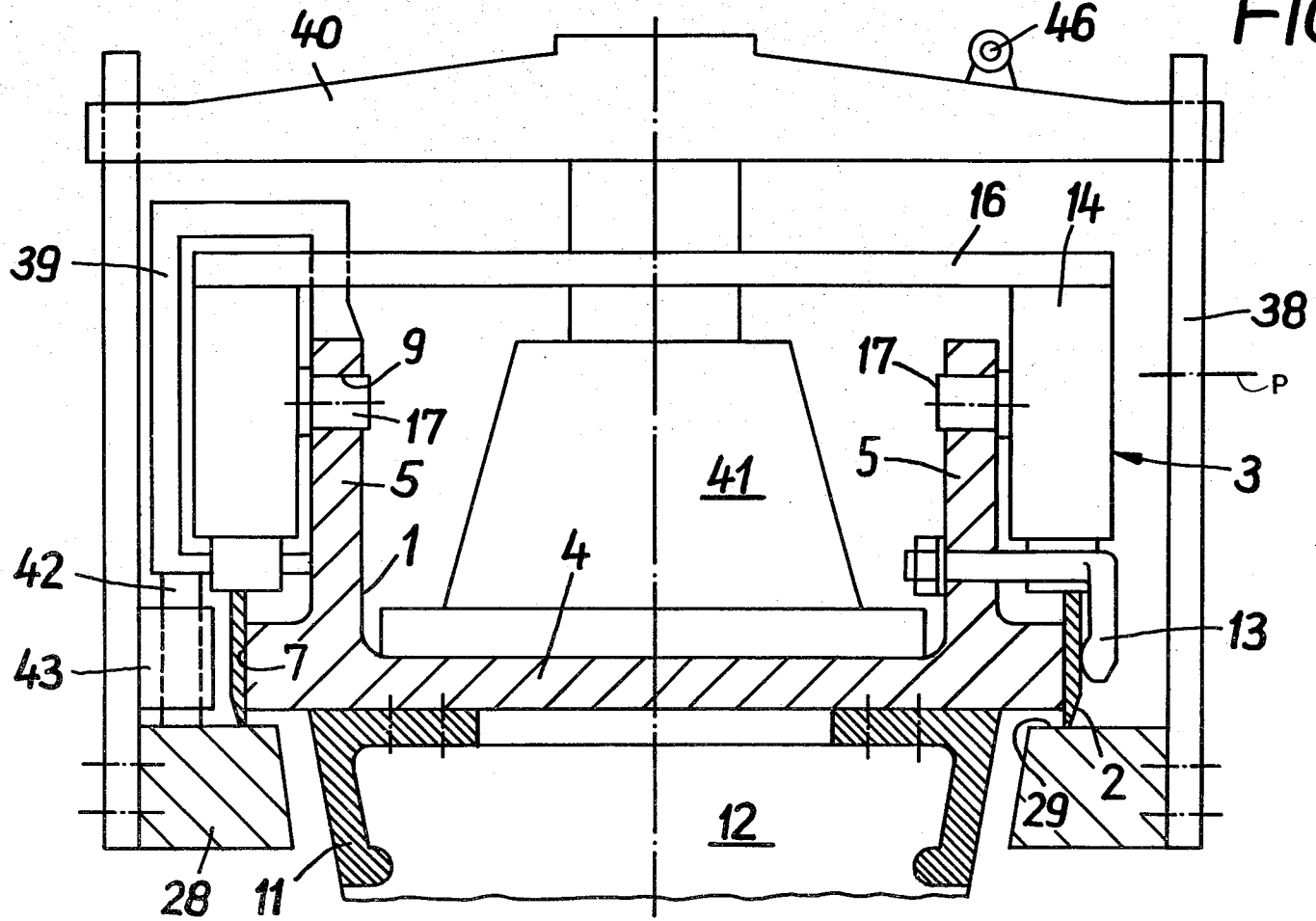
FIGS. 3 and 4 are sections taken along lines III—III and IV—IV, respectively, of FIG. 1.
Figure 4:
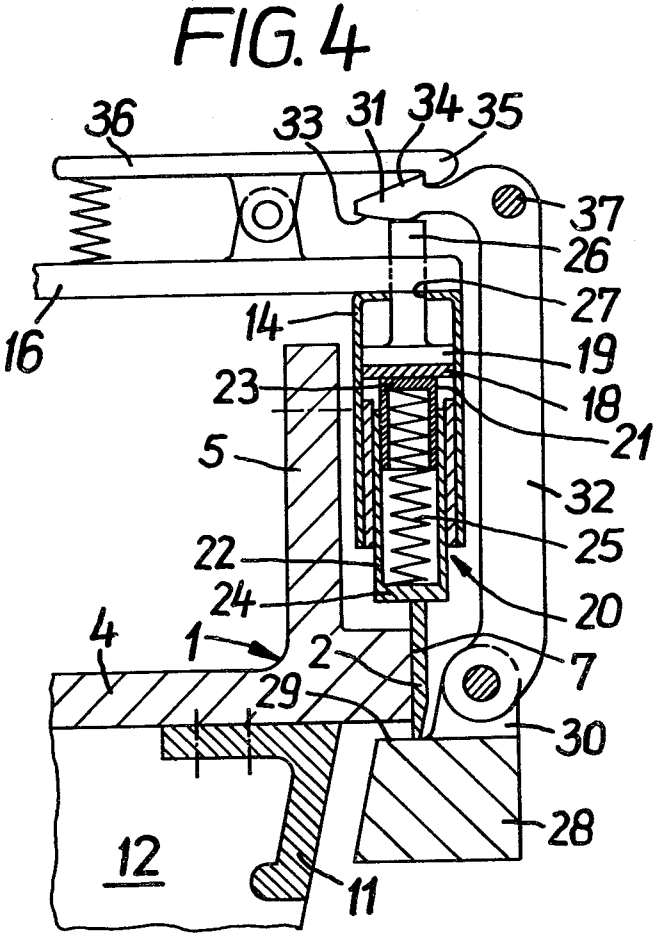

The seal strip 2, which may in fact be comprised of a plurality of longitudinally abutting sections, is normally retained against the edges 7 and 8 by standard hook bolts 13 extending through the flanges 5 and 6. In addition the outer (upper in FIG. 3) edges of these strips 2 are braced against small biasing devices or tensioners 20 each formed as best seen in FIG. 4 with an inner cylindrical cup 21 and an outer cylindrical cup 22 having respective closed bases 23 and 24 between which a compression spring 25 is received. The base 24 of the outer cup 22 bears against the outer edge of the strip 2 and the base 23 of the inner cup 21 bears against the underside of a rail 18 that is displaceable in the frame 3 perpendicular to its plane.

The frame 3 also includes transverse or horizontal stiffening members 16 parallel to the end members 15. At the ends of these transverse stiffening members 16 are guided the stems 26 of plungers 19, holes 27 being formed through the upper wall 14 of frame 3 and the stiffening member 16 so that these plungers 19 can move perpendicular to the plane of the frame 3. Each plunger 19 bears at its lower end on the rail 18 and at its upper end can be engaged by a spacer 32.

The doorjamb 28 is formed along each of its vertical sides with five pairs of lugs 30 each pivoting the inner end of one of the spacer hooks 32. These hooks 32 have outer ends 31 formed on one side with a camming surface 33 engageable with the respective plunger stem 26 and on its outer side with a hook 34 over which another hook 35 of a lever 36 pivoted on the member 16 can engage. All of the spacers 32 on one side of the doorjamb 28 are interconnected at their outer ends by a vertically extending rod 37.

In addition to the above-described structure the doorjamb 28 is provided with two pairs of standard lock hooks 38 and the door is provided with guides 39 that ride on the insides of these hooks 38 to ensure accurate positioning of the door during mounting back in doorjamb 28. Standard pivotal locking levers 40 with respective tensioning units 41 are provided for engaging these hooks 38. In addition as seen in FIG. 3 each of the lock hooks 38 carries a horizontally inwardly projecting abutment 43 on which a spacer 42 carried on the guide 39 can engage. Thus the door is normally lowered in place by a standard door machine with the guides 39 ensuring side-to-side positioning between the hooks 38 and the pins 42 first serving for up-and-down control until they engage the surface 29.

Once the door is thus positioned the levers 40 are pivoted together, normally with a rod 46 connected between them to operate them jointly. The spacer hooks 32 are then pivoted up so as to cam in the respective plungers 19 and force the seal 2 into engagement with the face 29 with a carefully controlled force.

Figure 5:
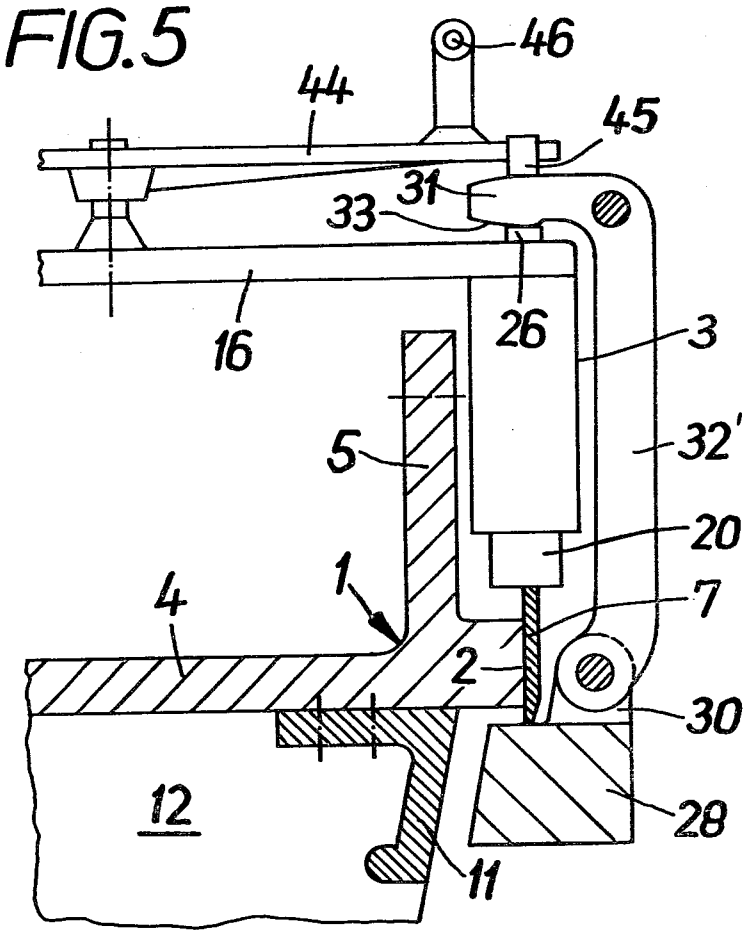
FIG. 5 is a view similar to FIG. 4 showing another arrangement according to the instant invention.

In FIG. 5 an arrangement is shown wherein spacer hooks 32′ are provided which are locked in place on respective plunger stems 26 by a locking arm 44 carrying an abutment 45 and pivotal about an axis perpendicular to the respective door panel 4, rather than vertical and parallel thereto as shown in FIG. 4.

With the system according to the instant invention, therefore, the door is mounted on the coke oven in the standard manner, then the spacers 32 or 32′ are swung in so as to exert on the seal 2 a carefully controlled biasing force. Even if the door body 1 warps considerably due to the effects of heat the spacing established by the spacers 32 and 32′ will remain virtually the same, so that a good seal will be formed around the outer edges 7 and 8 of the door.

I claim:

1. A coke-oven door assembly comprising:
   - a doorjamb having an outwardly facing annular doorjamb surface;
   - a rigid door body having an annular outer edge aligned with and generally perpendicular to said doorjamb surface;
   - an annular and hollow rigid frame juxtaposed with said edge;
   - an annular seal strip engaging said edge and bearing inwardly on said doorjamb surface;
   - a rail inside said frame and movable toward and away from said doorjamb surface;
   - a plurality of elastically compressible biasing devices engaged between said rail and said strip and urging same toward said doorjamb surface; and
   - means including a plurality of spacers engaged between said doorjamb and said rail for maintaining said rail at a predetermined spacing from said doorjamb.

2. The assembly defined in claim 1 wherein said door body and frame are limitedly relatively displaceable and have pivot and slide joints between themselves, whereby thermally caused distortions of said door body are not transmitted to said frame.

3. The assembly defined in claim 1 wherein said spacers are hooks pivoted on said doorjamb and having outer ends operatively engageable with said rail.

4. The assembly defined in claim 3 wherein said means for maintaining said rail at a predetermined spacing from said doorjamb further includes respective plungers guided on said frame and engageable between said outer ends of said hooks and said rail.

5. The assembly defined in claim 4 wherein said outer ends each have a camming surface turned toward and engageable with the respective plunger.

6. The assembly defined in claim 5 wherein said doorjamb has two parallel sides and two parallel ends, said hooks being pivoted at said sides about axes parallel thereto.

7. The assembly defined in claim 1 wherein each of said devices include a pair of telescoping cylinders having closed bases and a spring braced therebetween.

8. The assembly defined in claim 1, further comprising means for retaining said seal strip against said edge while permitting inward and outward displacement of said seal strip.

9. The assembly defined in claim 1 wherein said door body has a central panel and an outwardly projecting flange, said frame being carried on said flange.

10. The assembly defined in claim 1 wherein said frame is formed as a box beam.

* * * * *